United States Patent [19]

Fowler

[11] 4,206,554

[45] Jun. 10, 1980

[54] HEAT CYCLING APPARATUS AND METHOD FOR BULK CURING TOBACCO

[76] Inventor: Joe W. Fowler, Rte. 2, Box 39, Reidsville, N.C. 27320

[21] Appl. No.: 943,242

[22] Filed: Sep. 18, 1978

[51] Int. Cl.[2] ..... F26B 3/04

[52] U.S. Cl. ..... 34/34; 34/54; 34/210; 34/233; 432/500; 131/134; 131/140 R

[58] Field of Search ..... 131/134, 135, 140 R; 62/408; 34/34, 54, 210, 212, 215, 224, 225, 232, 233, 45; 432/500

[56] References Cited

U.S. PATENT DOCUMENTS

| | | | |
|---|---|---|---|
| 2,826,824 | 3/1958 | Campbell | 34/34 |
| 3,075,700 | 1/1963 | Bishop | 236/DIG. 6 |
| 3,910,757 | 10/1975 | Taylor et al. | 432/500 |
| 3,972,674 | 8/1976 | Harrell | 432/500 |
| 4,026,036 | 5/1977 | Tanaka | 34/54 |
| 4,114,288 | 9/1978 | Fowler | 34/93 |

*Primary Examiner*—Larry I. Schwartz
*Attorney, Agent, or Firm*—B. B. Olive

[57] ABSTRACT

A heat cycling apparatus and method is provided for a bulk tobacco curing barn having at least two chambers in which the tobacco is cured in bulk utilizing a pressurized heat source. The heated curing air is directed first to one chamber and then to the other on a predetermined repetitive time cycle. Crops other than tobacco may be cured or dryed with the same apparatus and method on an appropriate time cycle.

10 Claims, 2 Drawing Figures

HEAT CYCLING APPARATUS AND METHOD FOR BULK CURING TOBACCO

BACKGROUND OF THE INVENTION

1. Field of the Invention

The invention is directed to apparatus and methods for drying crops and specifically to the heating apparatus and methods employed for bulk curing of tobacco.

2. Description of the Prior Art

Apparatus and methods for bulk curing of tobacco and for drying other crops by circulation of heated air through the crops have been well documented in numerous prior patents. U.S. Pat. Nos. 3,105,713; 3,910,757; 3,972,674 and 3,999,303 are cited by way of example.

It has also been known to utilize a single pressurized heating source for curing tobacco or other crops in a plurality of curing barns or chambers. U.S. Pat. Nos. 3,910,757 and 3,972,674 illustrate this method and apparatus for curing crops. These same prior art patents also teach the concept of having a common heat source which can be selectively connected to one or more barns or chambers. The prior art has, however, failed to recognize the possibility for achieving substantial energy savings and other advantages by using a common heat source for bulk curing of crops with duct and control system which allows two or more chambers to be heated alternatively and in a predetermined repetitive time sequence when the chambers are filled with tobacco or another crop being cured or dried. More specifically, while the prior art has provided method and apparatus enabling a single heat source to supply heat to a plurality of barns or chambers simultaneously or to only certain of the barns at any one time, the prior art has not taught method or apparatus directed to utilizing a plurality of barns or chambers and cycling the heat from a common heat source to the chambers or barns on a predetermined, repetitive time schedule so that only one chamber or barn receives the heat at any particular time but all chambers or barns receive heat on a repetitive time sequence.

SUMMARY OF THE INVENTION

The method and apparatus of the invention is directed to providing a plurality of curing chambers or barns, a common heat source and means by which heated air can be supplied from the heat source to each chamber sequentially and on a pretermined, repetitive time cycle. A mechanically driven baffle arrangement allows the heat to be directed first to one chamber and then another in a predetermined time sequence. Also, if desired, the sequential heat cycling apparatus may be de-energized and the baffle arrangement left in a position wherein the heat is directed exclusively to one chamber only.

DESCRIPTION OF THE PREFERRED EMBODIMENT

The present invention is particularly useful for bulk curing tobacco but is applicable to curing or drying of other crops. Further, the invention may be used either with a curing barn having a plurality of chambers, for example, as in U.S. Pat. No. 3,105,713, or with a system of completely separate barns providing separate and isolated heating chambers such as illustrated, for example, in U.S. Pat. No. 3,910,757. Also to be recognized is that the invention applies to either the type of curing barn in which the heated air is directed upwardly as, for example, in U.S. Pat. No. 3,105,713 or downwardly as in U.S. Pat. No. 3,999,303. While broadly applicable to a number of different types of curing chamber and barn arrangements as just explained, the invention is illustrated as applied to a bulk tobacco curing barn having two separate curing chambers to which heat can be supplied selectively on a repetitive time schedule.

Figure 1:
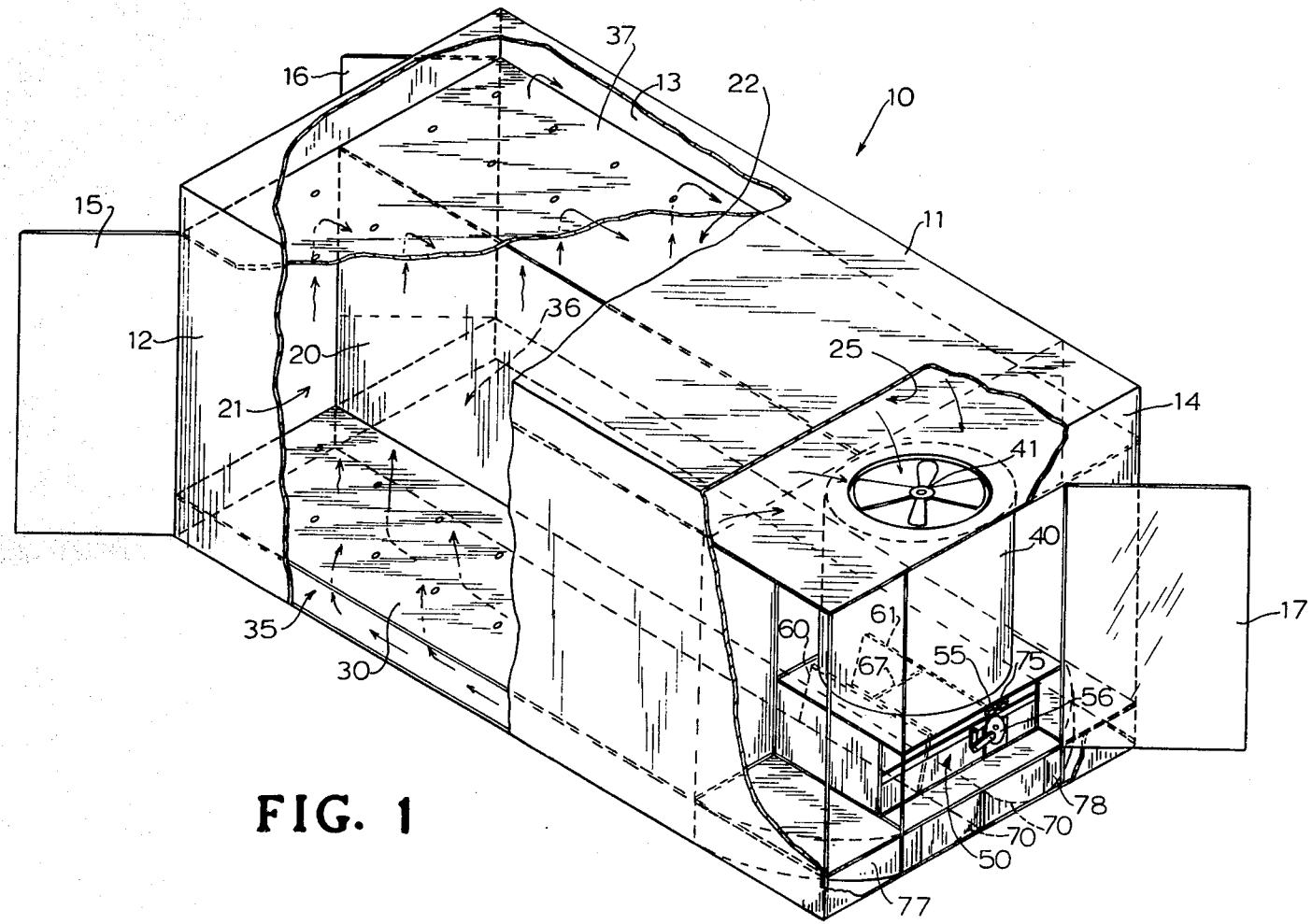
FIG. 1 is a cutaway perspective view of a tobacco curing barn adapted for the method and apparatus of the invention.

Referring to FIG. 1, there is shown a bulk tobacco curing barn 10 having a top wall 11, side walls 12, 13, end wall 14, loading doors 15, 16, and furnace door 17.

A partition 20 divides barn 10 into two heating chambers or compartments 21, 22, both of which communicate with a common overhead plenum chamber 25 above a perforated wall 37 which may or may not be required, depending on the type barn, bulk or rack arrangement, and the like. While not shown, it is to be understood that tobacco or other crops requiring drying would be placed in the heating chambers 21, 22 in bulk curing boxes, on bulk curing racks, or the like. Alternatively, there may be provided an open mesh floor 30 on which certain crops to be dried could be placed directly. In some types of bulk curing tobacco barns, the partition 20 is not needed since bulk curing boxes are used to establish and isolate the heating chambers.

Below the heating chambers 21, 22 separate plenum chambers 35, 36 are provided such that pressurized, heated air from a common source 40 may be directed either to plenum 35 or plenum 36 and thus cause the pressurized heated air to be selectively directed to either heating chamber 21 or heating chamber 22. The pressurized heat source 40 may comprise an oil, gas, electric or other source of heat and with a fan 41 to establish pressure to the system and with appropriate temperature and safety controls, as well as fresh air controls, not shown.

In some types of bulk curing tobacco barns, the space above ground and below the floor or bulk curing boxes and between side and end walls may be utilized as the desired plenum chambers 35, 36. Also, each bulk curing box may be treated as a heating chamber. In other instances, ducts are provided to direct the heated air from the furnace to spaces above or below the tobacco or other crop and such ducts may be considered as comprising or being part of the plenum chambers 35, 36.

Figure 2:
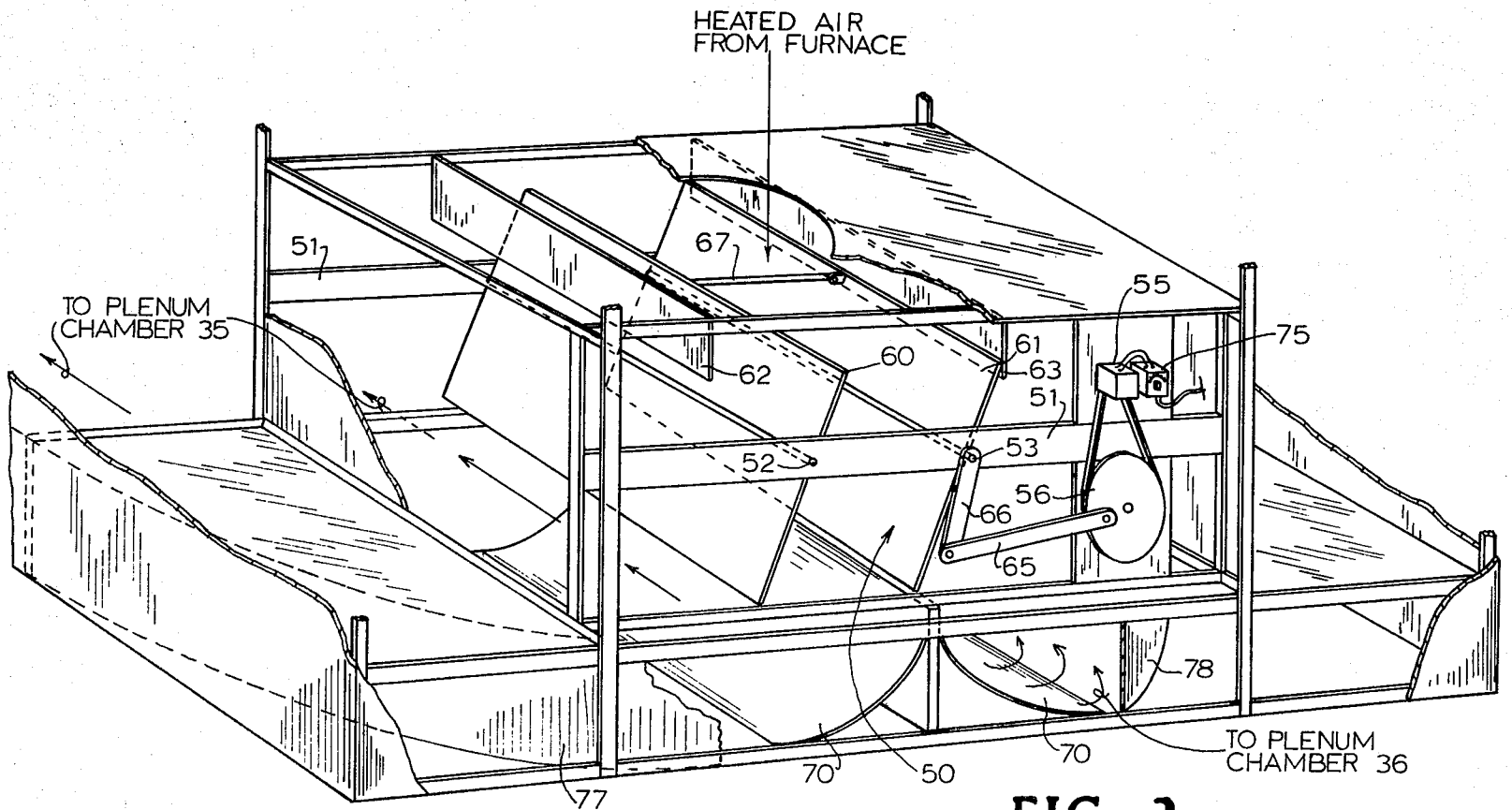
FIG. 2 is a perspective view of the duct and movable baffle arrangement enabling the heat to be cycled first to one chamber and then another in a predetermined time sequence and with certain wall portions broken away or removed for purposes of illustration.

Referring next to FIG. 2, the air flow control system 50 generally consists of a frame means 51 having attachment means to the existing barn furnace support structure and determining the rotation points 52, 53, and providing support for cam wheel drive motor 55 and cam wheel 56. Directional vanes 60, 61 preferably rotate through an oscillating arc of about 30° as driven by cam 56 acting on lever arms 65 and 66. The directional vanes 60, 61 move in parallel action and are connected by linkage 67. An appropriate duct divider 70 acts as the continuation of the air flow paths established through directional vanes 60, 61 to provide at each extreme position, e.g., as in FIG. 2, of linkage 65 for substantially all or at least the major portion of the pressurized heated air and flow to be directed along suitable duct walls 77, 78 either to the plenum chamber 35 and thus to the heating chamber 21 or alternatively to the plenum chamber 36 and to the heating chamber 22. A time switch 75 is preferably provided such that the vanes 60, 61 will be moved to one position, held for a predetermined time, for example, three minutes, and then moved back to the opposite position. Assuming other factors and characteristics of air flow are stable, as the penetration of air through the tobacco or other crop being cured or dried is a function of available pressure, the quantity of hot air directed to a selected chamber will be effectively doubled for a given power input during the time vanes 60, 61 are positioned to direct the heated air to such chamber.

From the description just given, it can be seen then that as motor 55 operates, cam 56 is caused to turn and the vanes 60, 61 are caused to move back and forth in a predetermined repetitive time cycle and thus the pressurized heated air is directed alternatively to first plenum chamber 35 and corresponding heating chamber 21 and then to plenum 36 and corresponding heating chamber 22. Bars 62, 63 act as vane seats and stops.

According to well-known principles of the drying process in farm products, it is recognized that brief cycling, that is, off and on, does not extend the time of drying. This is because the time of drying is usually determined by the maximum rate at which moisture will be given off by the crop being cured under a given condition of temperature. Prior research as undertaken by several university systems engaged in tobacco research have proven the practicality of cycling the electric fan off and on. However, there has been a limitation in the reduction of the cycle time due to the hazards of frequent high in-rush current of motor starting. Thus, it can be seen that the present invention allows continuous operation of the fan motor at one-half or less of normal horsepower requirements corresponding to the on-off cycle system of the invention. The cost of electrical generating capacity and distribution to serve seasonal peak loads such as those associated with crop curing is well documented. The present invention, thus, has obvious energy conservation advantages. To fully appreciate such advantages and the magnitude of the energy problem and known solutions prior to the present invention, reference is made to the conference and conference paper entitled "Energy and Bulk Tobacco Barns", Myrtle Beach, South Carolina, Nov. 14–15, 1977, sponsored jointly by the Food and Energy Council and the American Society of Agricultural Engineers.

While a barn having two heating compartments has been used for illustration, it is to be understood that the method and apparatus of the invention have application to any number of barns or heating chambers so long as heated air can be directed to such barns or chambers in the repetitive time sequence previously described with respect to the illustrated example. Thus, the claims when directed to a method and apparatus utilizing two heating chambers, are to be interpreted as being directed to any other number of interconnected barns or chambers having at least two such barns or chambers.

What is claimed is:

1. An apparatus for drying crop material, comprising:

(a) a drying barn having plural heating compartments and means to store the crop material therein distributed among said compartments;

(b) heat source means having means to heat and pressurize air passing therethrough;

(c) recirculating ducting and positionable baffle means associated with said heat source means and compartments, said ducting means including one plenum chamber communicating with one side of all said compartments and with said heat source means and other plenum chambers each of which communicates with only one of said compartments on an opposite side thereof and with said heat source means thereby enabling substantially the entire output of heated air from said heat source means to be directed through said other plenum chambers and opposite side of each said compartment separately dependent on positioning of said baffle means; and (d) drive and timing means for switching said baffle means between selected positions on some predetermined repetitive time cycle whereby said baffle means operates to direct substantially the entire output of said heat source means to said other plenum chambers separately, successively and in a predetermined repetitive sequence and time cycle.

2. An apparatus as claimed in claim 1 wherein said barn is adapted to store tobacco and said compartments comprise at least a pair of bulk tobacco curing compartments.

3. An apparatus as claimed in claim 2 wherein said compartments comprise two adjacent bulk tobacco curing compartments.

4. An apparatus as claimed in claim 1 wherein said heat source means includes an electrically driven fan for pressurizing air flowing therethrough and means to maintain said heat source means and fan in continuous operation throughout the drying of said crop material in all said compartments.

5. The method of drying a crop, comprising:

(a) establishing a source of pressurized heated air;

(b) distributing the crop to be dried in a pair of heating compartments having one plenum chamber communicating with said source of heated air and both compartments on one side thereof and a pair of plenum chambers on an opposite side of both compartments each of which communicates with said source of heated air and only one of said compartments; and (c) directing substantially the entire heated air output from said source first to one and then to the other of said pair of plenum chambers separately and successively through controllable ducting means and on a predetermined time schedule and repetitive sequence governed by an unattended mechanism controlling said ducting means and time schedule to dry said crop in both said compartments.

6. The method of claim 5 wherein said crop comprises tobacco and said drying comprises curing of said tobacco in and wherein said crop distribution comprises distributing said tobacco bulk in at least a pair of bulk tobacco curing compartments.

7. The method of claim 5 wherein said compartments comprise two adjacent compartments.

8. The method of claim 5 including the step of utilizing a fan to pressurize said source of heated air and maintaining said fan in continuous operation throughout the drying of said crop in both said compartments.

9. The method of drying crop material, comprising:

(a) establishing a source of pressurized heated air;

(b) storing the material in plural heating compartments communicating through recirculating flow path controllable ducting means including one plenum chamber communicating with one side of all said compartments and with said source of pressurized air and other plenum chambers each of which communicates with only one of said compartments on an opposite side thereof and with said source of pressurized air; and (c) directing substantially the entire output of heated air from said source through said controllable ducting means to said other plenum chambers separately, successively and in a predetermined sequence and time cycle to dry said material in all said compartments.

10. The method of drying a crop, comprising:

(a) distributing the crop to be dried among plural heating compartments;

(b) establishing a continuous source of pressurized heated air at a temperature appropriate to the nature of the crop to be dried; and (c) directing substantially the entire heated air output from said source to each said compartment separately and successively through controllable ducting means and on a predetermined time schedule coordinated with the rate at which moisture will be given off under the prevailing crop and compartment conditions governed by an unattended mechanism controlling said ducting means and time schedule to dry said crop in each said compartment at the drying rate appropriate thereto.

* * * * *

UNITED STATES PATENT AND TRADEMARK OFFICE

CERTIFICATE OF CORRECTION

PATENT NO. : 4,206,554

DATED : June 10, 1980

INVENTOR(S) : Joe W. Fowler

It is certified that error appears in the above—identified patent and that said Letters Patent is hereby corrected as shown below:

Col. 2, line 51, "or" should be --of--.

Col. 4, line 63, --in-- should be inserted after "tobacco".

Signed and Sealed this

*Thirtieth* Day of *September 1980*

[SEAL]

*Attest:*

SIDNEY A. DIAMOND

*Attesting Officer*

*Commissioner of Patents and Trademarks*